US006769886B2

(12) United States Patent
Henderson

(10) Patent No.: US 6,769,886 B2
(45) Date of Patent: Aug. 3, 2004

(54) ROTARY VANE PUMP WITH VANE WEAR ACCESS PORT AND METHOD

(75) Inventor: Timothy H. Henderson, 2041Cullen Rd., Gibsonville, NC (US) 27249

(73) Assignee: Timothy H. Henderson, Gibsonville, NC (US)

( * ) Notice: Subject to any disclaimer, the term of this patent is extended or adjusted under 35 U.S.C. 154(b) by 0 days.

(21) Appl. No.: 10/315,327

(22) Filed: Dec. 10, 2002

(65) Prior Publication Data

US 2003/0124010 A1 Jul. 3, 2003

Related U.S. Application Data

(63) Continuation-in-part of application No. 10/195,784, filed on Jul. 15, 2002, now Pat. No. 6,565,337, which is a continuation of application No. 09/767,763, filed on Jan. 23, 2001, now Pat. No. 6,450,789.

(51) Int. Cl.[7] ..... F04C 18/344
(52) U.S. Cl. ..... 418/2; 418/1
(58) Field of Search ..... 418/1, 2, 252

(56) References Cited

U.S. PATENT DOCUMENTS

| | | | |
|---|---|---|---|
| 706,158 | A | 8/1902 | Charles |
| 2,781,000 | A | 2/1957 | Thomas et al. |
| 3,036,527 | A | 5/1962 | Peterson |
| 3,191,852 | A | 6/1965 | Kaatz et al. |
| 3,301,194 | A | 1/1967 | Brunson |
| 3,398,884 | A | 8/1968 | Kaatz et al. |
| 3,463,384 | A | 8/1969 | Kilbane |
| 3,469,500 | A | 9/1969 | Lutz et al. |
| 3,552,895 | A | 1/1971 | Bayley |
| 3,565,558 | A | 2/1971 | Tobacman |
| 4,804,317 | A | 2/1989 | Smart et al. |
| 4,820,140 | A | 4/1989 | Bishop |
| 5,318,409 | A | 6/1994 | London et al. |
| 5,720,598 | A | 2/1998 | de Chizzelle |
| 6,318,147 | B1 | 11/2001 | Steinruck et al. |
| 6,368,066 | B2 | 4/2002 | Alyama et al. |

FOREIGN PATENT DOCUMENTS

AU B-82659/91 10/1991

OTHER PUBLICATIONS

Fruitland Tool and Mfg., Fruitland Vacuum Pump Operation and Maintenance Manual, Stoney Creek, ON, Canada.

Mannesmann–Demag, Instruction Manual and Spare parts List for Air–Cooled Rotary Compressors and Vacuum Pumps, Nr. BE 10/1982/3US, 1982, Schopfheim, Germany. See p. 14.

Blackmer, Blackmer Rotary Vane Compressors Installation, Operation and Maintenance Instructions, Model: E56, E106, E156, Oct. 1999, Grand Rapids, MI USA. See pp. 7–8.

*Primary Examiner*—John J. Vrablik
(74) *Attorney, Agent, or Firm*—Adams Evans P.A.

(57) ABSTRACT

A rotary vane pump, including a housing within which is rotatably mounted a rotor having a plurality of slots therein with a vane positioned for sliding movement within each of the slots. An access port is formed in the housing communicating with the rotor at a reference position in relation to the slots. The access port is sized to permit alignment of any one of the slots with the access port by rotating the rotor, maintaining the vane within the aligned one slot and at a datum within the slot, and permitting entry into the access port of an aligned slot of a stylus having a predetermined length in relation to the datum for determining the length of the vane. A determination of whether wear to the vane has met or exceeded a predetermined amount can be determined by reference to a portion of the stylus exterior to the access port.

20 Claims, 11 Drawing Sheets

ROTARY VANE PUMP WITH VANE WEAR ACCESS PORT AND METHOD

This application is a continuation-in-part of application Ser. No. 10/195,784, filed Jul. 15, 2002 no U.S. Pat. No. 6,565,337, which is a continuation of application Ser. No. 09/767,763, filed Jan. 23, 2001, now U.S. Pat. No. 6,450,789 issued Sep. 17, 2002.

TECHNICAL FIELD AND BACKGROUND OF THE INVENTION

The present invention relates to rotary vane pumps having self-lubricating sliding vanes. More particularly, the present invention is directed to a method and apparatus for inspecting the sliding vanes in a rotary vane pump to determine the amount of wear to the vanes without having to disassemble the pump housing.

Sliding rotary vane pumps have been used for several years for a multitude of mechanical and industrial applications and can be exposed to a wide range of environmental conditions. These pumps can be used in both gas and liquid pumping applications. One type of sliding rotary vane pump is a dry air pump. In the general aviation field prior to the early 1960's, the vacuum systems which powered gyros were driven by pumps which were lubricated by oil and referred to in the art as wet pumps. In the 1960's, the oil lubricated, or wet vane vacuum pumps, were replaced by dry vacuum pumps constructed of carbon vanes and rotors which were self-lubricating. To this present day, the standard dry vacuum pumps in the market comprise mechanical carbon rotors and vanes operating in a hardened metal ellipsoidal cavity. These pumps provide a power source for, among other things, gyroscopically controlled, pneumatically operated flight instruments.

A dry air type rotary vane pump usually has a rotor with slots with a radial component of alignment with respect to the rotor's axis of rotation, vanes that reciprocate within these slots, and a chamber contour within which the vane tips trace their path as they rotate and reciprocate within their rotor slots. The reciprocating vanes thus extend and retract synchronously with the relative rotation of the rotor and the shape of the chamber surface in such a way as to create cascading cells of compression and/or expansion, thereby providing the essential components of a pumping machine.

Because dry air pumps do not use a liquid lubricant, other forms of dry lubrication have been developed. For example, vanes for rotary pumps have been manufactured from carbon material as disclosed in U.S. Pat. No. 3,191,852 issued to Kaatz, et al. on Jun. 29, 1965. These vanes are fabricated by compressing carbon, graphite and various organic binders under high pressure and temperature. U.S. Pat. No. 4,804,317 issued to Smart, et al. on Feb. 14, 1989, discloses a carbon composite material used for the side plates and vanes of the rotary pump. A composite carbon part is fabricated by combining carbon based tensile strength fibers (in a cloth weave) with graphite and an organic binder. Although providing improved performance over the prior carbon parts, similar wear, chipping and fracture problem exist with composite carbon parts. U.S. Pat. No. 4,820,140 issued to Bishop on Apr. 11, 1989, discloses a self-lubricating coating applied to the pump parts to inhibit wear between the slidable vanes and pump rotor. The coating is comprised of a mixture of lead and polytetrafluoroethylene deposited on the surface of the part to be coated.

While these lubricating methods work well for dry pump applications, the nature of the vane lubrication technique is destructive to the pump. Certain parts of these pumps are made of carbon or carbon graphite. These parts rub against other stationary or moving parts of the pump during operation. Graphite from these parts is deposited on the opposing parts by the rubbing action and forms a low friction film between the parts, thereby providing lubrication. The deposited graphite film is itself worn away by continued operation of the pump, and is eventually exhausted out of the pump. The film is replaced by further wear of the carbon graphite parts. Thus, lubrication is provided on a continuous basis that continuously wears away the carbon graphite parts. The vanes of the pump require and provide the majority of lubrication. Therefore, the vanes wear and lose length as the pump operates. At some point in time, the length of the vanes will become so short that they will not slide properly in the slot, which may lead to pump failure.

Failure of a dry air pump can render one or more aircraft systems inoperative. In addition, most pump failures occur in flight. Dry air pump performance is generally unaffected by wear on the vanes until total failure. Moreover, pump efficiency does not typically degrade enough to be noticed by the pilot until total failure. Usually, pump operation is monitored based on the aircraft's vacuum gauge. If the pump is not operating correctly, the vacuum gauge will indicate such. However, this generally does not occur until near complete failure of the pump.

A correlation exists between the remaining length of the vanes and the expected future operational life of the pump. The inventor has determined that the incidence of structural failure of the vane/rotor combination begins to increase appreciably after the vanes wear to a certain length. The incidence of failures continues to increase and the rate of failure per unit time increases dramatically as the vanes continue to wear shorter.

The inventor has studied various dry air pump failures and determined that until the vane reaches about 74% of its original length, failure due to mechanical malfunction arising from reduced vane length is unlikely. The total failure rate from all causes for pumps with vanes having remaining lengths about equal to or greater than 74% is less than about 5% of the operating population. By the time remaining vane length reaches about 64% of the original length, about 50% of installed pumps have failed, and more than 90% of those failures can be traced to malfunctions relating to vane length. When the remaining vane length falls below 64% of the original length, more than 98% of the installed pumps studied have failed, and 95% of those failures are related to vane length.

While vane wear occurring as a result of graphite deposition for lubrication is normal, fairly predictable, and reasonably slow, vane wear can be accelerated if the carbon graphite parts rub against roughened interior surfaces of the pump. Roughness of the interior surfaces can occur through many different causes, such as elevated temperatures and pressures, dirty filters, etc. Regardless if the vane wear is normal, or abnormally accelerated, when the vane length reaches a certain percentage of the original length, the likelihood of pump failure increases significantly. The current state of the art relating to dry air pump performance and efficiency does not adequately address how to determine when the vanes of the pump have reached a point requiring pump replacement or repair. Presently, there is no effective and simple way to inspect the state or rate of wear of the vanes in this type of pump. There is also no simple and cost effective way to determine the remaining useful life of a dry air pump. Currently, to ensure proper pump performance, the operation time for dry air pumps is monitored. When the number of hours of pump usage reaches a predetermined and arbitrary figure, the pump is removed and a new pump is installed. This is neither cost effective nor efficient since the pump may have a significant amount of usage time still available, or, if wear was abnormally fast, would not be done in time.

What is lacking in the art is a simple and inexpensive way of determine vane length in a pump to determine the state of wear, the rate of wear, and potential remaining life of dry air rotary pump vanes. Such a feature would allow, in some cases, a knowledgeable technician to determine whether other pump or related system failures or malfunctions are attributable to vane length. Thus, the opportunity arises to remove from service pumps likely to fail. In addition, opportunities arise to make adjustments or repairs to related aircraft systems to correct other malfunctions determined by inspection of the dry air pump. By correcting system malfunctions that might cause the pump to operate in an overload condition, pump life may be extended, and unscheduled downtime for the aircraft can be avoided.

SUMMARY OF THE INVENTION

Therefore, it is an object of the invention to provide an improved method of determining the remaining useful life of a rotary vane pump without having to disassemble the pump to make that determination.

More particularly, it is an object of the present invention to provide a method of viewing the vanes within a rotary pump, and particularly dry air pumps, without having to disassemble the pump.

It is a further object of the present invention to provide a rotary pump housing that permits a determination of vane length, state of vane wear, the rate of vane wear and the potential remaining life of the rotary pump.

It is yet a further object of the present invention to provide a method for assessing the remaining life of a rotary pump by visually or by means of a gauge or stylus determining the length of the vanes in the pump without having to disassemble the pump.

These and other objects of the present invention are achieved in the preferred embodiments disclosed below by providing a rotary vane pump, comprising a housing within which is rotatably mounted a rotor having a plurality of slots therein with a vane positioned for sliding movement within each of the slots. An access port is formed in the housing communicating with the rotor at a reference position in relation to the slots. The access port is sized to permit alignment of any one of the slots with the access port by rotating the rotor, maintaining the vane within the aligned one slot and at a datum within the slot, and permitting entry into the access port of an aligned slot of a stylus having a predetermined length in relation to the datum for determining the length of the vane. A determination of whether wear to the vane has met or exceeded a predetermined amount can be determined by reference to a portion of the stylus exterior to the access port.

According to one preferred embodiment of the invention, the access port is positioned on a sidewall of the stator for accessing the rotor along an axially-extending surface thereof and for accessing the aligned vane along a longitudinal axis concentric with the longitudinal axis of the vane.

According to another preferred embodiment of the invention, the stylus is mounted for sliding movement within a sleeve.

According to yet another preferred embodiment of the invention, the probe includes a flange for being positioned against the housing adjacent the access port for stabilizing the probe and aligning the longitudinal axis of the stylus with the longitudinal axis of the aligned vane.

According to yet another preferred embodiment of the invention, the predetermined datum point comprises a radially-innermost end of the aligned vane.

According to yet another preferred embodiment of the invention, the stylus includes a first indicia indicating that vane wear is within an acceptable limit for continued use and a second indicia indicating that vane wear has reached or exceeded an acceptable limit and that replacement is required.

According to yet another preferred embodiment of the invention, the stylus includes a first color thereon that, when exterior to the access port, indicates that vane wear is within an acceptable limit for continued use, and a second color thereon that, when only the second color is exterior to the access port, indicates that vane wear has reached or exceeded an acceptable limit and that replacement is required.

According to yet another preferred embodiment of the invention, the vanes are radially-aligned on the rotor.

According to yet another preferred embodiment of the invention, the vanes are canted from a radius of the rotor.

According to yet another preferred embodiment of the invention, the vanes are canted from a radius of the rotor, and a longitudinal axis of the access port is aligned with the longitudinal axis of the aligned vane.

According to yet another preferred embodiment of the invention, the stylus is spring-loaded for urging the vane to the datum point within the aligned slot.

According to yet another preferred embodiment of the invention, the stylus is spring-loaded for urging the vane to the datum point within the aligned slot.

According to yet another preferred embodiment of the invention, the access port is circular in cross-section and the diameter of the access port is about the same as the thickness of the slots.

An embodiment of the method according to the invention involves determining wear to a vane of a rotary vane pump of the type having a plurality of vanes positioned for sliding movement within a plurality of respective slots formed in a rotor mounted for rotation in a pump housing. A preferred embodiment of the method comprises the steps of determining a reference position on the housing in relation to the slots, providing an access port in the pump housing at the reference position, rotating the rotor to align one of the slots with the access port, moving the vane in the one slot to a predetermined datum point, inserting a stylus into the access port and into contact with the vane in the aligned slot, and determining by reference to an indicia associated with the stylus whether wear to the vane has met or exceeded a predetermined amount.

According to yet another preferred embodiment of the invention, the step of providing an access port comprises forming the access port through an endwall of the housing from an exterior surface to an interior surface thereof.

According to yet another preferred embodiment of the invention, the step of providing an access port comprises forming the access port through a sidewall of the housing from an exterior surface to an interior surface thereof.

According to yet another preferred embodiment of the invention, the step of providing an access port comprises providing a bore extending through a sidewall of the housing from an exterior surface to an interior surface thereof.

According to yet another preferred embodiment of the invention, the step of inserting the stylus into the aligned slot comprises the step of positioning a sleeve within which the stylus is contained for sliding movement against an outer surface of the housing adjacent the access port.

According to yet another preferred embodiment of the invention, the step of determining by reference to an indicia associated with the stylus whether wear to the vane has met or exceeded a predetermined amount comprises the steps of placing on the stylus a first color that, when exterior to the access port, indicates that vane wear is within an acceptable limit for continued use, and placing on the stylus a second color that, when only the second color is exterior to the access port, indicates that vane wear has reached or exceeded an acceptable limit and that replacement is required.

According to yet another preferred embodiment of the invention, a rotary machine is provided, and comprises a housing within which is rotatably mounted a rotor having a plurality of slots therein with a vane positioned for sliding movement within each of the slots. An access port in the housing communicates with the rotor at a reference position in relation to the slots. The access port is sized to permit alignment of any one of the slots with the access port by rotating the rotor. The vane is maintained within the aligned one slot and at a datum within the slot. A stylus is introduced into the access port and into contact with an aligned vane of a stylus having a predetermined length in relation to the datum for determining the length of the vane. A determination of whether wear to the vane has met or exceeded a predetermined amount can thus be determined by reference to a portion of the stylus exterior to the access port.

DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
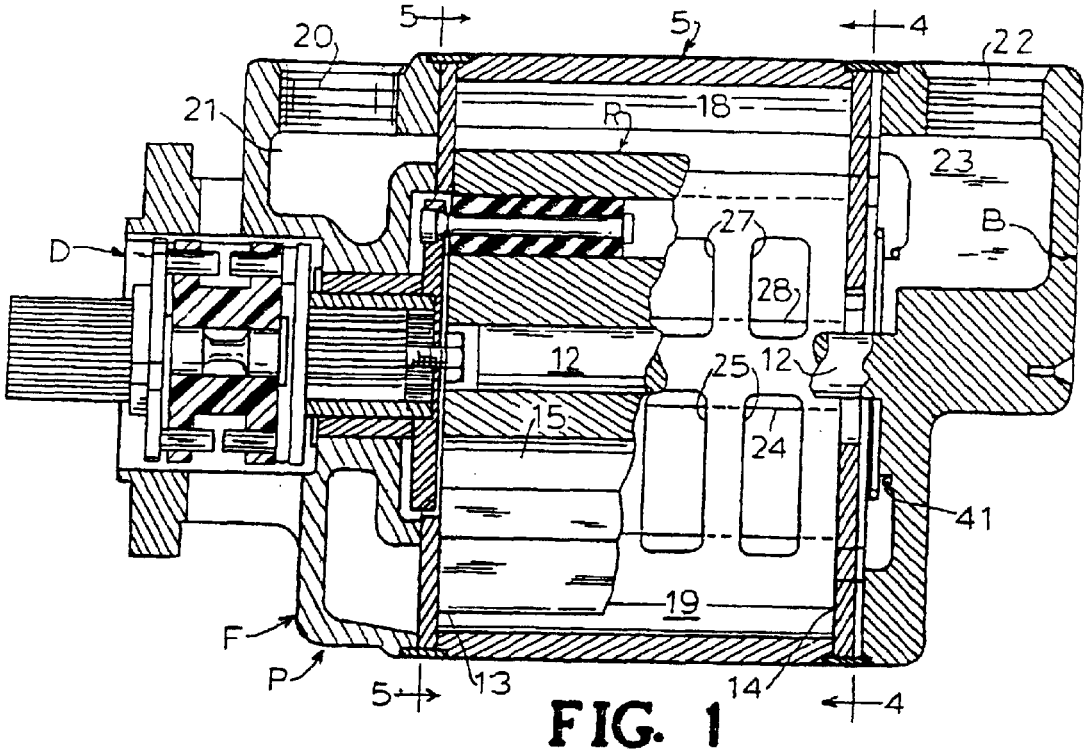
FIG. 1 PRIOR ART
FIG. 1 is a longitudinal sectional view through the centerline of a known rotary pump.

Referring now specifically to the drawings, a known vane pump is illustrated in FIGS. 1–5. As illustrated in FIG. 1, the rotary vane-type pump P has a central annular body or stator S, a rotor R, a front flange F secured to an inlet end of stator S, a back flange B secured to the outlet end of stator S, and a drive assembly D mounted on the front flange F for driving rotor R.

Figure 2:
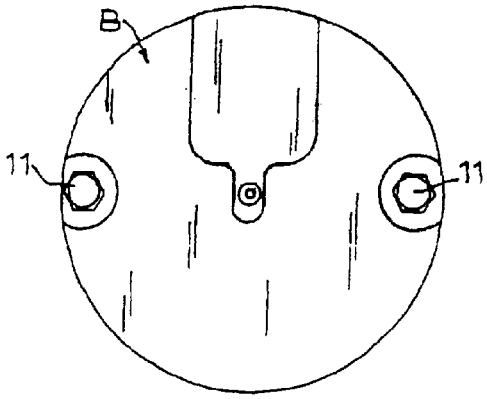
FIG. 2 PRIOR ART
FIG. 2 is an end elevation from the rear end of the rotary pump of FIG. 1.
Figure 3:
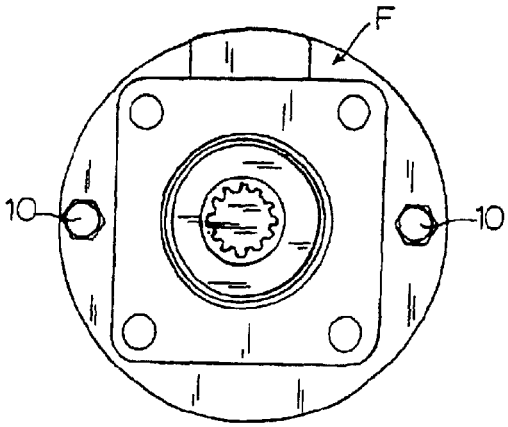
FIG. 3 PRIOR ART
FIG. 3 is an end elevation from the front end of the rotary pump of FIG. 1.
Figure 8:
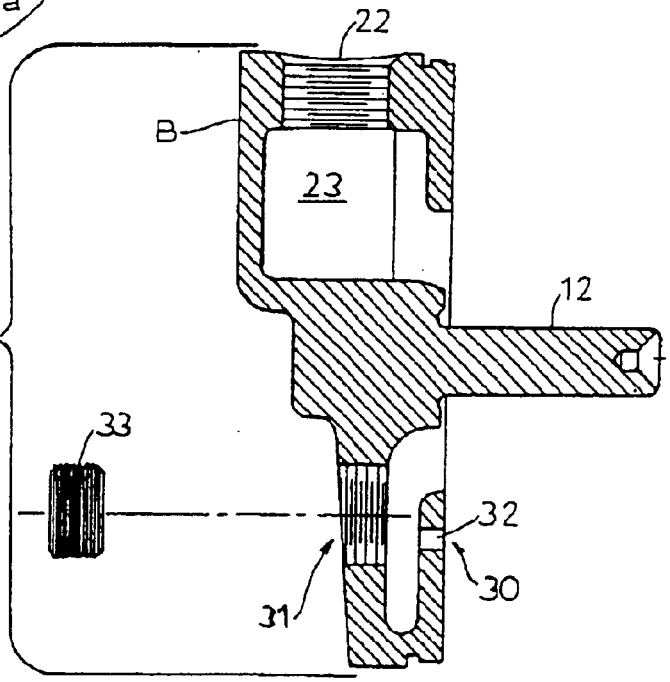
FIG. 8 is a side view of a rear flange of a rotary pump according to another aspect of the present invention.

Front flange F and back flange B can secured to stator S by any known type of securing device as long as the pump parts S, F, and B are securely held in place during operation. FIGS. 2 and 3 illustrate the back flange B and front flange F being secured to stator S by two sets of screws 10 and 11, respectively. Each set of screws 10 and 11 are diametrically opposed on back flange B and front flange F. Preferably, back flange B and front flange F are mounted to stator S such that screws 10 are coaxially aligned with screws 11. Back flange B is provided with a central stud 12 which extends into and at least partially through stator S to provide a journal for rotor R. The forward end of rotor R rests against an annular inlet plate 13 interposed between front flange F and stator S. The opposite end of stator S rests against a floating end plate 14 interposed between stator S and back flange B. Alternatively, back flange B can be secured directly to stator S without interposing an intermediate plate. FIG. 8 illustrates a back flange B that can be secured directly to stator S.

Rotor R has a central bore that receives journal 12, and that provides a bearing surface for rotary movement of rotor R about its central axis. In the illustrated embodiment, rotor R is provided with six circumferentially spaced vane slots 15 that are angled slightly from a radial direction, and extend over the entire longitudinal length of rotor R. Each slot 15 receives a vane 16 that slides in and out of slot 15 as rotor R is rotational driven about its center axis.

Each vane 16 is preferably made from a material that during use, wears and produces a form of dry lubrication for the pump P. For example, vanes 16 can be made from carbon material, graphite, and various organic binders. A self-lubricating coating may be applied to the pump parts to inhibit wear between the slidable vanes 16 and pump rotor R. In addition, each vane 16 can be provided with a metal jacket 17 to enhance strength. The jacket 17 is not essential to the present invention, however.

Figure 4:
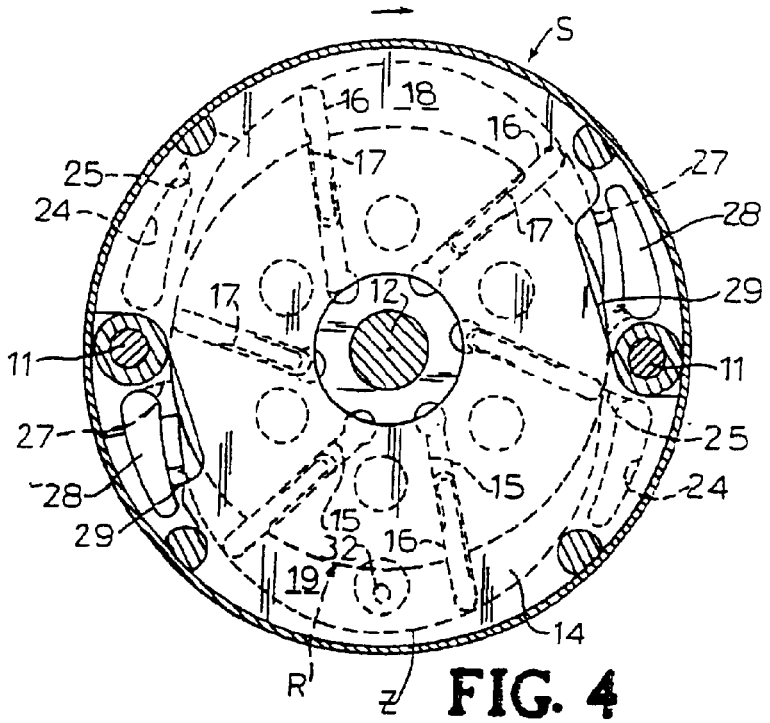
FIG. 4 PRIOR ART
FIG. 4 is a transverse sectional view taken on the line 4—4 of FIG. 1.
Figure 5:
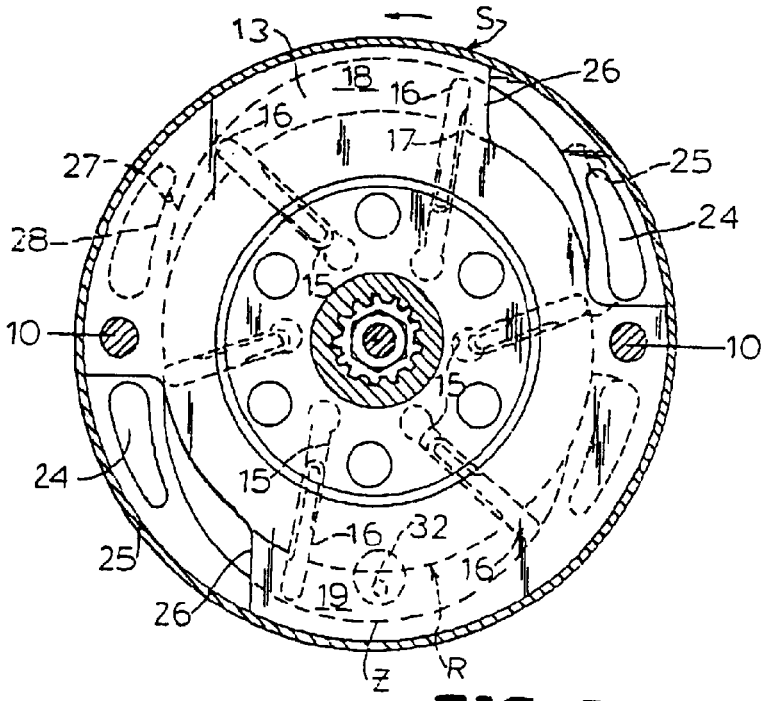
FIG. 5 PRIOR ART
FIG. 5 is a transverse sectional view taken on the line 5—5 of FIG. 1.

Referring to FIGS. 4 and 5, stator S is provided with two symmetrically opposite lobes 18 and 19, the surfaces of which act as cams that regulate the two extension and retraction cycles for the vanes 16 during each rotation of rotor R. The longitudinal spaces defined by adjacent vanes 16, rotor R, the surface of a stator lobe, and the end plates 13 and 14 serve as pumping pockets which are moved from an intake zone to an exhaust zone to accomplish the pumping action. Air enters pump P through an inlet fitting 20 in the front flange F and passes to an annular inlet chamber 21, also within the front flange F. The air is exhausted through an outlet fitting 22 in the back flange B that communicates with an outlet chamber 23, also formed in the back flange B.

Entering air passes from the inlet chamber 21 to one of two longitudinally extending inlet passages 24 in the stator S that extend from end-to-end therethrough. Each inlet passage 24 communicates with the pumping pockets in the stator lobes through a series of spaced slots 25 formed in the wall of the stator S (FIG. 1). The inlet end plate 13 has two inlet ports 26 that permit passage of the entering air from the inlet chamber 21 to each of the two inlet passages 24, and thereafter to the pumping pockets.

Air is exhausted from the pumping pockets through another series of spaced slots 27 in the stator wall that communicate with two longitudinally extending exhaust passages 28 on the opposite sides of the stator S. The floating discharge end plate 14 is provided with two outlet ports 29 to permit passage of compressed air to the two outlet passages 28 in stator S and to the outlet chamber 23 in the back flange B.

Discharge end plate 14 is arranged to "float" in the back flange B in an axial direction. A helical spring 41 bears between the interior surface of the discharge end plate 14, and the back flange B and urges the end plate 14 against the end of the stator S to provide the end seal for the pumping pockets. Alternatively, as seen in FIG. 8, back flange B can be designed as a unitary element. Back flange B has a rear wall 30 integrally formed therein, and does not include a floating end plate 14. The floating characteristic of the end plate 14, however, is not essential to the invention.

Figure 6:
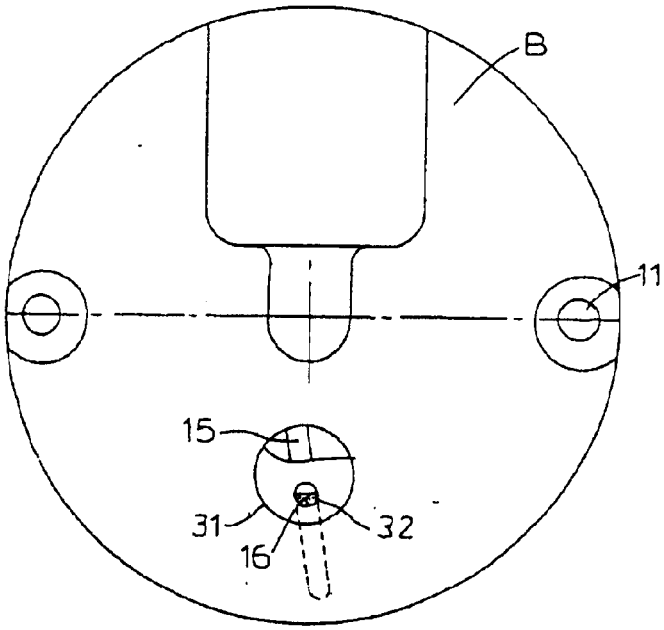
FIG. 6 is an end elevation of the rear flange including a view port according to an embodiment of the invention.
Figure 7:
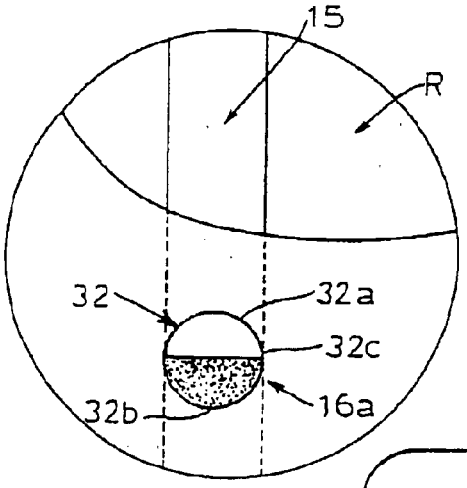
FIG. 7 is an enlarged view of the view port of FIG. 6.

FIGS. 6, 7, and 8 illustrate a first embodiment of the present invention. FIGS. 6 and 7 depict back flange B provided with a view port 31 and a calibrated or gauge hole 32 through which the inboard edge of the vane 16 can be seen under certain circumstances. The calibrated hole 32 is located such that after the pump has been operated for a predetermined number of hours, for example 800 hours, there is a high probability that the inboard edges of the pump vanes 16 will be observable in hole 32, one-by-one as the rotor is turned and the pump P is oriented for observation.

The observation may find the inboard edge of the vane 16 in an "upper" portion 32*a* (closest to the center of rotation of the rotor) of calibrated hole 32, midway in the hole 32*c*, or at the "bottom" portion 32*b* (farthest from the center of rotation of the rotor). The edge of the vane may not be visible in the calibrated hole at all, being above or below the upper or lower edges of the hole 32, respectively.

The position of the inboard edge of vane 16 at a known point in the operational life of the pump (e.g.; 800 hours of service) provides useful information as to the present state of wear of the vanes and the rate of wear up to that time. If the inboard edge of the vane is not visible and has not yet reached the upper edge 32*a* of the calibrated hole 32, the vane 16 has little wear, and the rate of wear, using the 800 hour example, would be considered unusually slow. If the inboard edge of vane 16 is not visible in the hole 32 and is below the bottom edge 32*b* of the calibrated hole 32, the state of wear, again using the 800 hour example, would be very advanced, and the rate of wear to that point would be considered unusually rapid. In such a case, the pump should be replaced and removed from service. If the inboard edge of vane 16 appears in the approximate center 32*c* of the calibrated hole 32 as shown in FIG. 7, wear of the vane and rate of wear are probably within normal limits. When the vane inboard edge appears in the approximate center of the hole 32, an additional 200 hours of wear, under normal operating conditions, should be expected until the inboard edge of the vane appears adjacent to the bottom 32*b* of the hole. When the inboard edge of the vane reaches the bottom of the hole, pump replacement is warranted.

The diameter of the calibrated hole 32 should be approximately equal to the reduction of length of a vane 16 after about 400 hours of use under normal operating conditions. Thus, when the inboard edge of vane 16 appears at the top 32*a* of the calibrated hole, an additional 400 hours of pump use should be expected under normal wear conditions on the vane. Accordingly, periodic observation of the position of the vane inboard edge in the calibrated hole 32 can help in determining the rate of wear of a vane 16, and by inference, the wear state, rate of wear of the pump P, and the remaining useful life of the pump P.

The radial location of the calibrated hole 32 should be selected to permit observation of each of vanes 16, one-by-one, as the rotor R is turned and when the vane 16 is at a point of maximum extension in the slot 15, i.e., when the leading edge of vane 16 is in contact with the wall of the stator S as indicated by the letter Z in FIGS. 4 and 5. The position correlates with a segment of the pump stator's curve where vane extension is constant. Other radial locations of the calibrated hole 32 may introduce significant errors. The distance from the rotor's centerline of rotation (and the pump's rotational centerline) correlates to a certain vane inboard edge position expected after a particular number of hours of operation at a normal wear rate. The diameter of the hole 32 corresponds to an expected amount of vane length wear over a period of time. That is, as the vane length decreases during pump use, the inboard vane edge will move radially outwardly in the slot.

Visual access to the calibrated hole 32 that is located in the inner wall 30 of the pump's back flange B (see FIG. 8), is gained by removing a cover, such as a threaded plug 33, from a larger view port 31 on the outside wall of back flange B. Plug 33 is preferably made from aluminum and is threaded in such a way that once tightened into the view port 31 is locked into position and does not require any additional locking mechanism. Aluminum is the preferred material for the plug because its coefficient of thermal expansion is the same as the back flange B of the pump P that is generally some form of anodized aluminum. This prevents undesirable strains and stress on back flange B of the pump during operation. Plug 33 is preferably coated with a corrosion-preventing material. The corresponding threaded hole in back flange B should also be treated to prevent galling between the two aluminum parts when assembled. Use of dissimilar metals for plug 33 and back flange B to prevent galling and overstraining the assembly when removing the plug could add weight or induce dissimilar metal corrosion or/and could induce undesirable stress through unequal coefficients of thermal expansion. The present inventive combination ensures weight reduction and avoidance of undesired stress. Furthermore, corrosion can be avoided through the use of innovative combinations of materials, treatments and thread design.

A further embodiment according the invention is illustrated in FIGS. 9–13. While the embodiment shown is a rotary vane-type pump 40, the invention is equally applicable to any apparatus that has rotating vanes or blades subject to wear.

The pump 40 has a stator 41 defining an interior chamber and a rotor 42, as described above. The rotor 42 has a central bore 43 that receives a journal 44, and that provides a bearing surface for rotary movement of rotor 42 about its central axis. In the illustrated embodiment, rotor 42 is provided with six circumferentially-spaced and radially-extending vane slots 45A–F that extend over the longitudinal length of rotor 42. Each slot 45A–F receives a respective vane 46, only vane 46 in slot 45C being shown, that slide in and out as the rotor 42 is rotationally driven about its center axis.

Stator 41 is provided with two symmetrically opposite lobes 47, 48, the surfaces of which act as cams that regulate the two extension and retraction cycles for the vanes 46 during each rotation of rotor 41.

Figure 9:
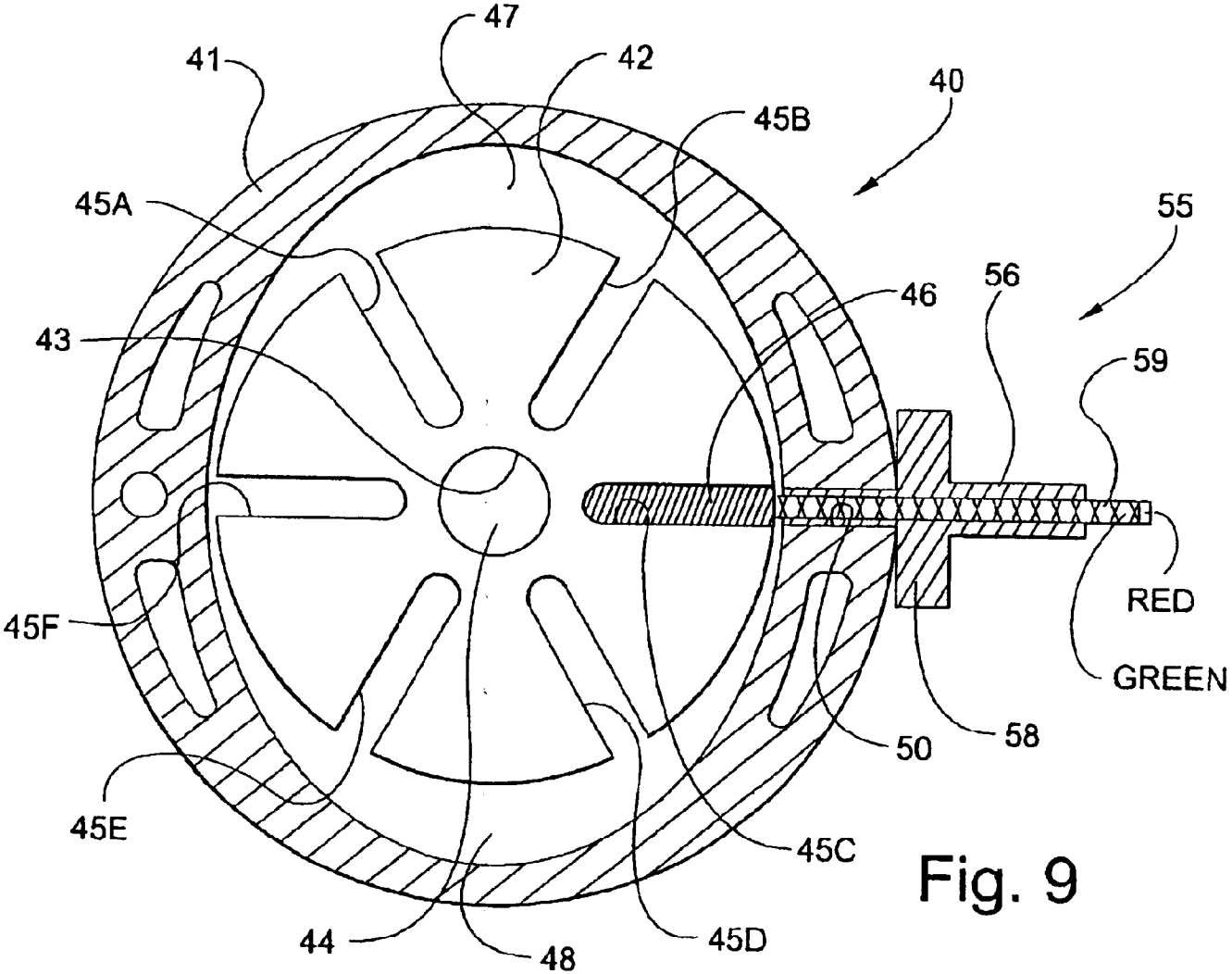
FIGS. 9–11 are vertical cross-sections of a vane pump according to an alternate embodiment wherein an exterior stylus is used to determine vane length.
Figure 10:
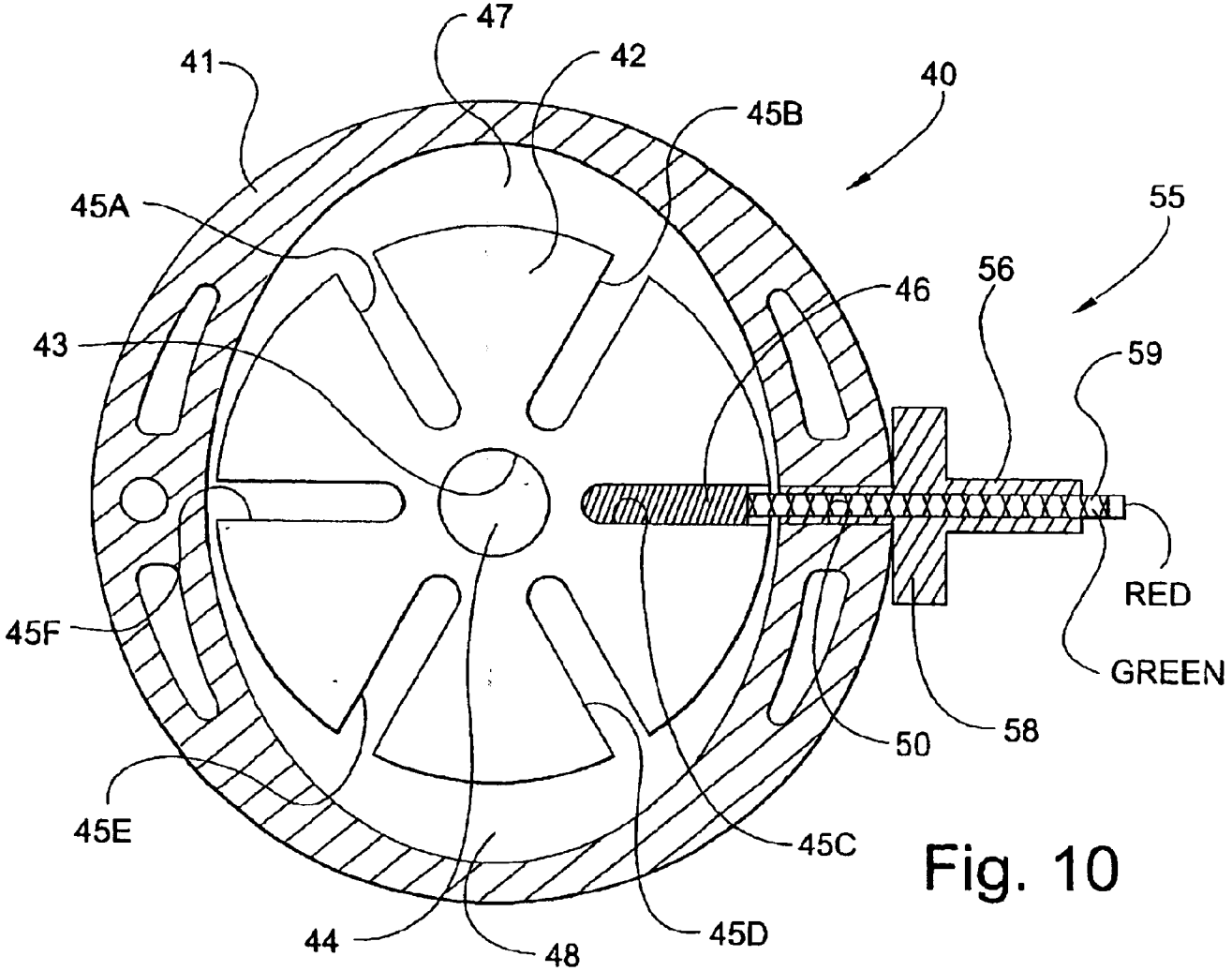
Figure 11:
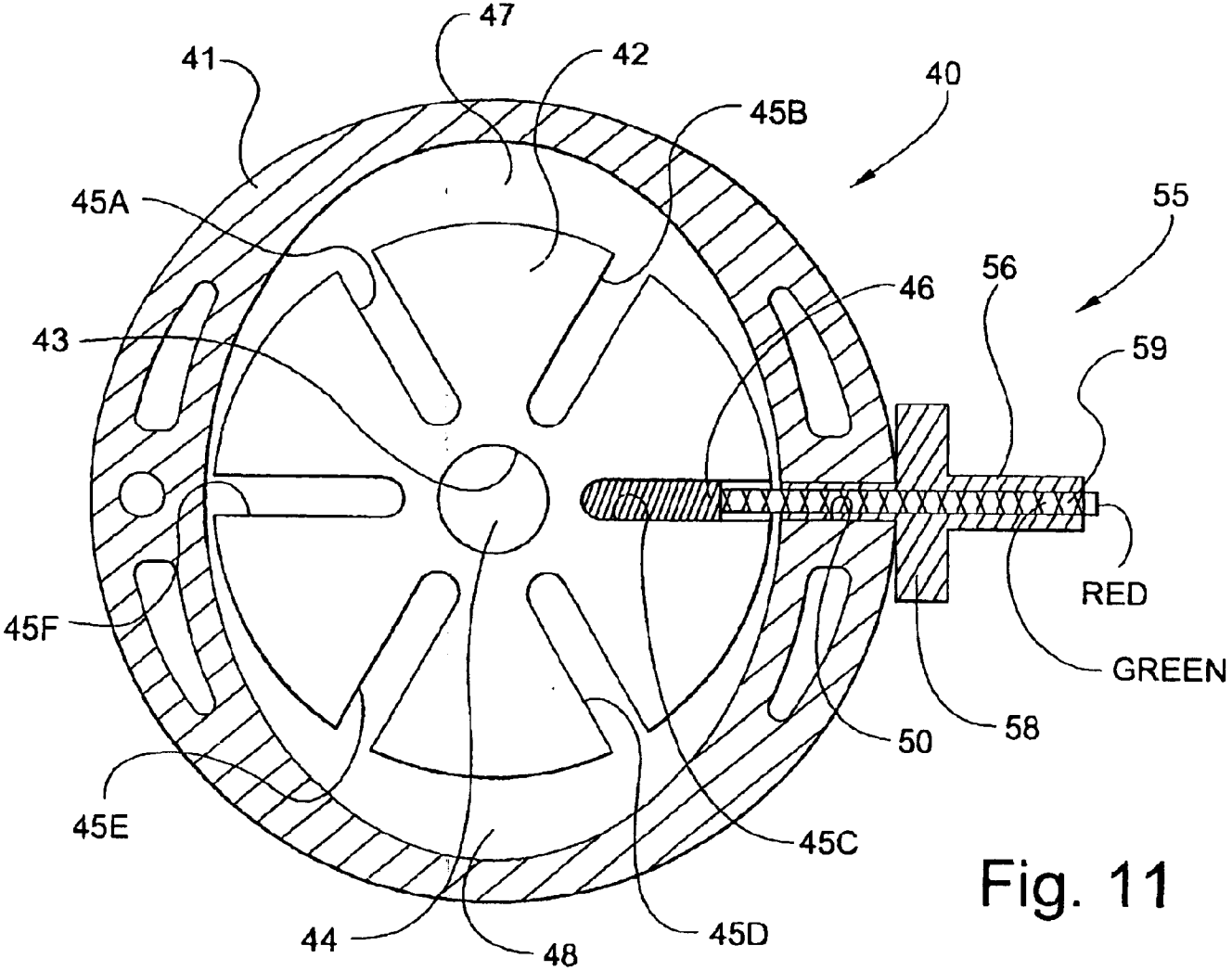

As is shown in FIGS. 9–11, the sidewall of the stator 41 is provided with an access port 50 that communicates with the chamber of the stator 41. Thus, rather than accessing the slots 15 from the side as shown in FIGS. 5–8, the slots 45A–F are accessed from the end of the slots 45A–F through the sidewall of the stator 41. Wear of the vanes 46 can be determined in a number of different ways.

As shown in FIGS. 9–11, progressive wear of the vanes 46 can be determined by means of a probe 55. The probe 55 may optionally include a sleeve 56 having an enlarged flange 58 on one end through which is positioned an elongate stylus 59. If a sleeve 56 is used, the stylus 59 is positioned in the sleeve 56 so as to slide back and forth. Inspection of a vane is carried out by rotating the rotor 42 until one of the slots 45A–F is aligned with the access port 50. The probe 55 is placed against the exterior wall of the stator 41 with the stylus 59 retracted. The stylus 59 is carefully inserted into the slot 46C, as shown, and extended into the access port 50 until the vane 46 has been pushed radially-inwardly to the point where it bottoms out at the end of the slot 46C. A predetermined length of the stylus 59 will remain exposed depending on the length of the vane 46 and thus the distance the vane 46 travels in the slot 45C before it bottoms out.

The stylus 59 is provided with some type of indicia from which the mechanic can determine the extent of wear. For example, as is shown in FIGS. 9–11, the stylus 59 is marked with a green color except for a red mark on the outer tip. So long as any of the green color shows, as in FIGS. 9 and 10, the vane 46 is within specifications and continued operation of the pump 40 without changing the vanes 46 is permitted. If only the red tip shows, as in FIG. 11, then the vane 46 must be replaced.

The process is repeated for each of the slots 45A–F, providing the mechanic with information regarding the wear of each of the vanes 46. The information gained can also provide the mechanic with derivative information such as the rate of wear or excessive rates of wear for particular ones of the vanes by comparing historical data recorded during prior inspections.

Care must be taken when inserting the stylus 59 into the slots 45A–F. Rotation of the rotor 42 while the stylus 59 is in a slot may break off the stylus 59 or damage the slot, rotor or vane and require disassembly. Thus, the stylus 59 should preferably be fabricated from a relatively soft material that will flex before breaking, and will not damage the rotor 42. Suitable materials that will not compress significantly along the longitudinal axis but are quite flexible include nylon.

The access port 50 can be placed at any desired position on the side of the stator 41, and because the vane 46 is being positively moved by the stylus 59 to the end of the slot 45C, the access port can be on the side of the stator 41, as shown in FIGS. 9–11, or even on the bottom. Of course, a datum must be established based on the location of the access port 50 so that the total length of the vane 46 and the distance from the surface of the rotor 42 to the inner wall of the stator 41 is known. The length of the stylus 59 and the location of the red and green marks are then calculated based on these values. For example, if an access port were placed at the 12 o'clock position as shown in FIGS. 9–11, the stylus 59 would be correspondingly longer in order to provide the same information about the remaining length of the vane 46.

Figure 12:
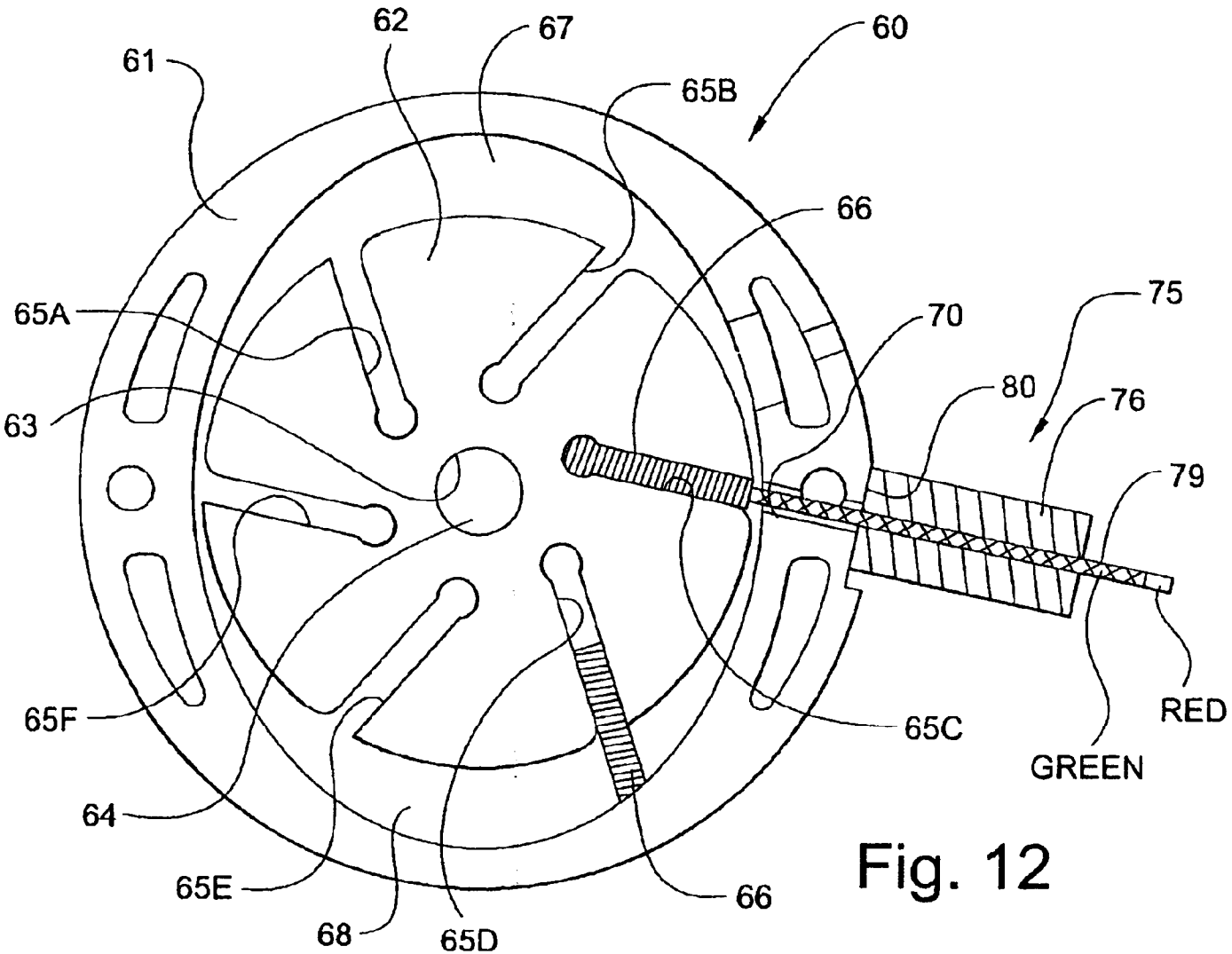
FIG. 12 is a vertical cross-section of a vane pump having canted vane slots.

Referring now to FIG. 12, a canted vane pump is shown at reference numeral 60. The pump 60 has a stator 61 defining an interior chamber and a rotor 62, as described above. The rotor 62 has a central bore 63 that receives a journal 64, and that provides a bearing surface for rotary movement of rotor 62 about its central axis. In the illustrated embodiment of FIG. 12, rotor 62 is provided with six circumferentially-spaced vane slots 65A–F that are angled, i.e., canted, slightly from a radial direction, and extend over the longitudinal length of rotor 62. Each slot 65A–F receives a respective vane 66, only vanes 66 in slots 65C and 65D being shown, that slide in and out as the rotor 62 is rotationally driven about its center axis.

Stator 61 is provided with two symmetrically opposite lobes 67, 68, the surfaces of which act as cams that regulate the two extension and retraction cycles for the vanes 66 during each rotation of rotor 61.

Figure 13:
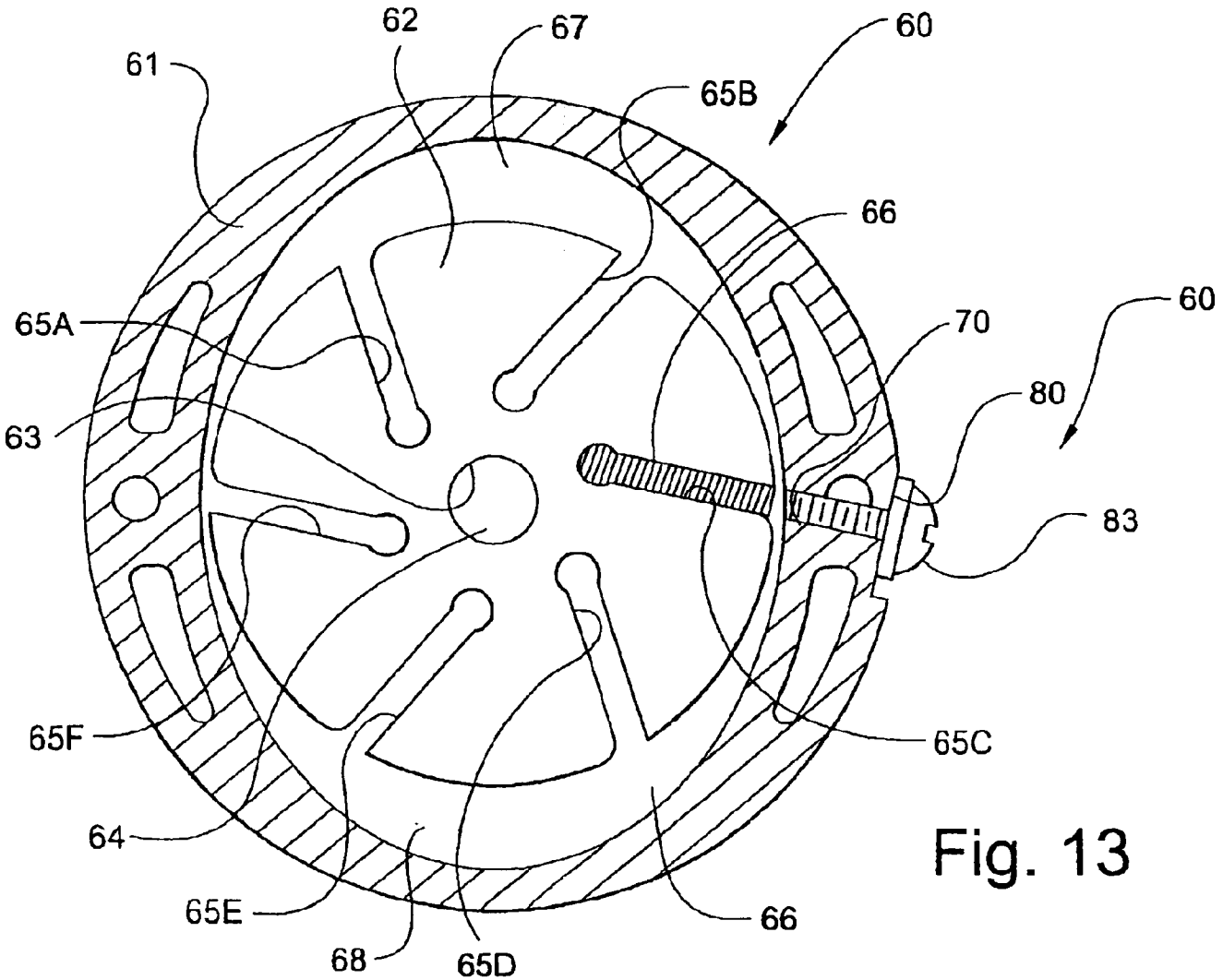
FIG. 13 is a vertical cross-section of the vane pump shown in FIG. 12 with the access port plugged.

As is shown in FIGS. 12–13, the sidewall of the stator 61 is provided with an access port 70 that communicates with the chamber of the stator 61. As shown in FIG. 12, progressive wear of the vanes 66 can be determined by means of a probe 75. The probe 75 may optionally include a sleeve 76 having an enlarged flange 78 on one end through which is positioned an elongate stylus 79. The exterior side wall of the stator 61 is provided with a flattened area 80 normal to the extended axis of a slot 65A–F when properly aligned with the access port 70, as shown in FIG. 12. By placing the sleeve 76 against the flattened area 80, proper alignment and thus proper insertion of the stylus 79 into the slot 65C is attained.

The stylus 79 is positioned in the sleeve 76 so as to slide back and forth. Inspection of a vane 66 is carried out by rotating the rotor 62 until one of the slots 65A–F is aligned with the access port 70. The determination of the remaining length of the vane 66 is carried out as described above with reference to FIGS. 9–11.

As is shown in FIG. 13, the access port 70 is plugged when not in use with, for example, a screw 83.

Figure 14:
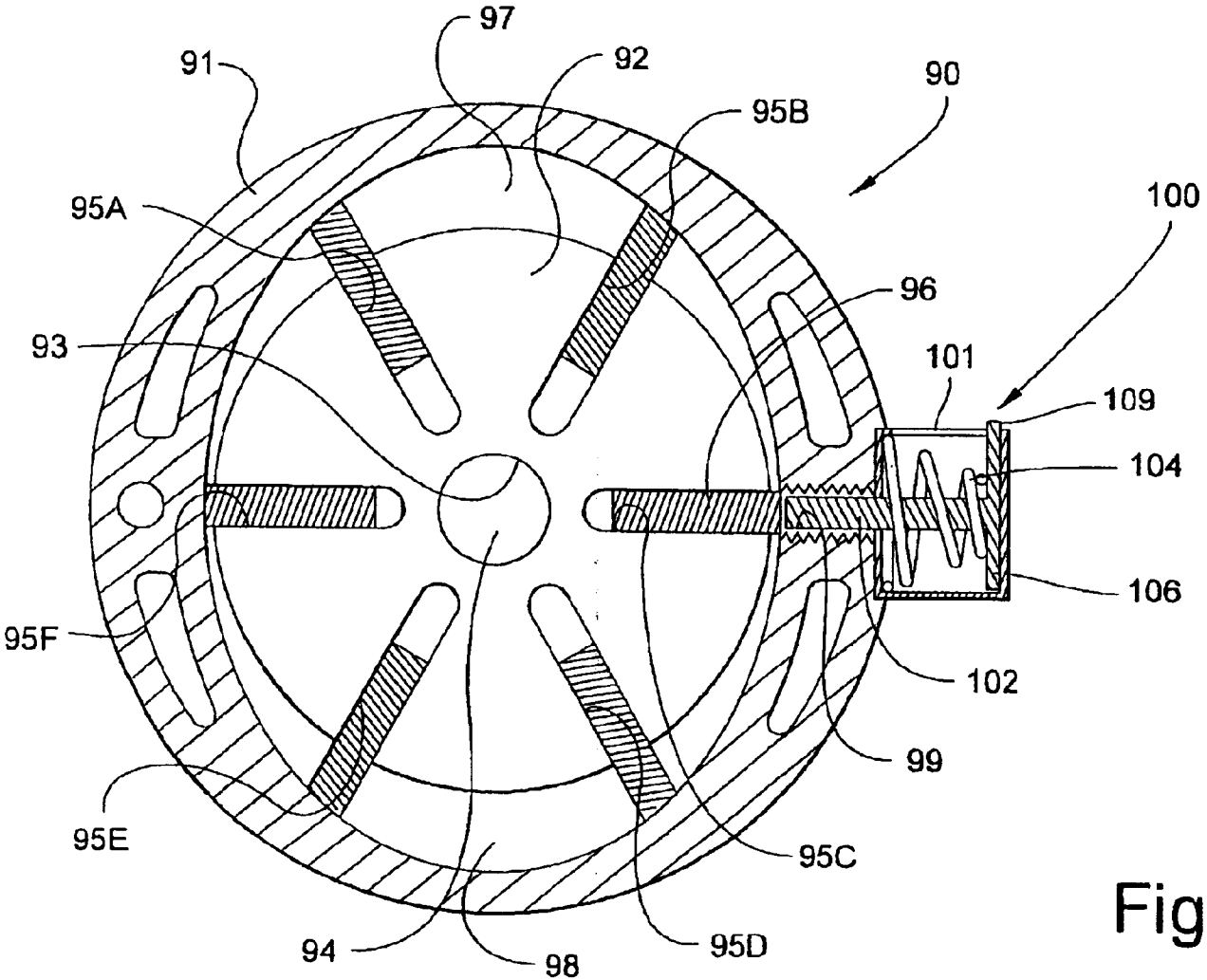
FIG. 14 is a vertical cross-section of a vane pump of a further alternate embodiment wherein a spring-loaded exterior stylus is used to determine vane length.
Figure 15:
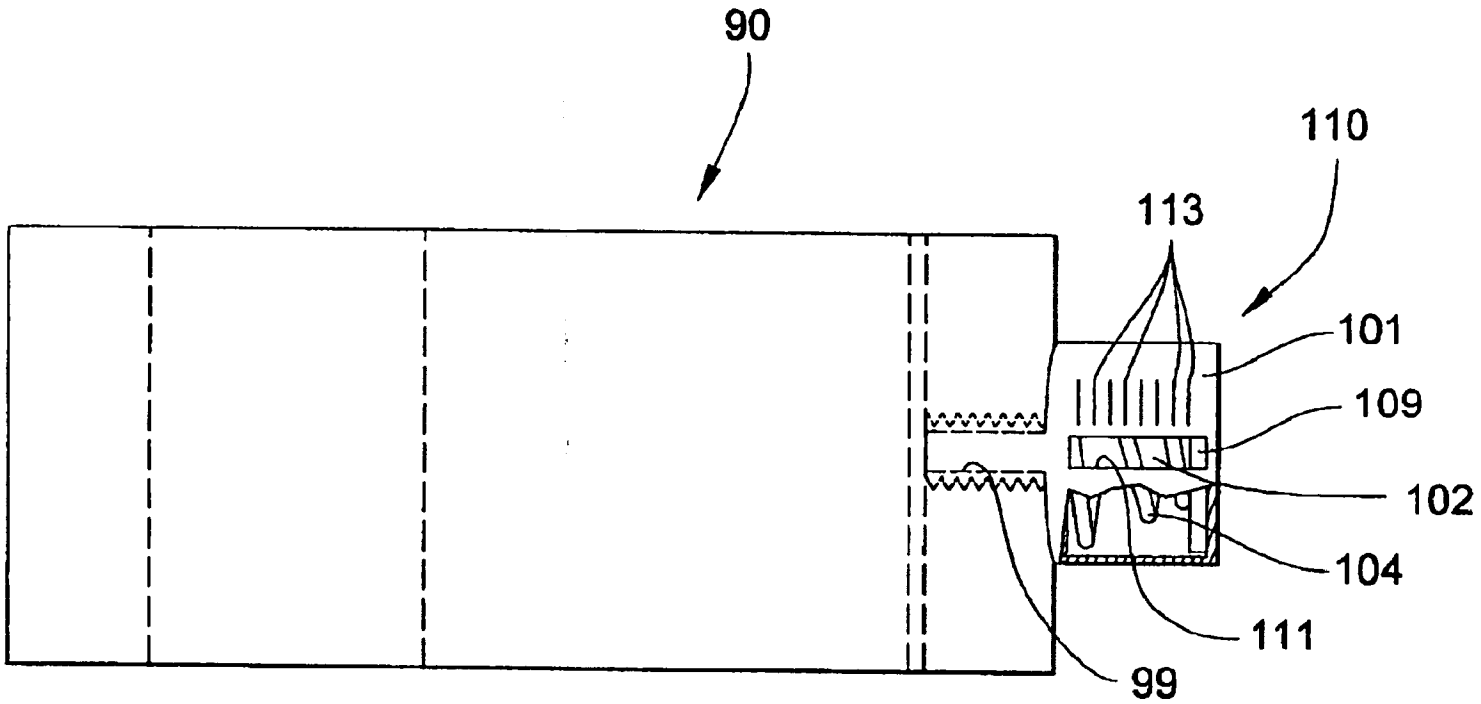
FIG. 15 is a top view of the vane pump shown in FIG. 14.
Figure 16:
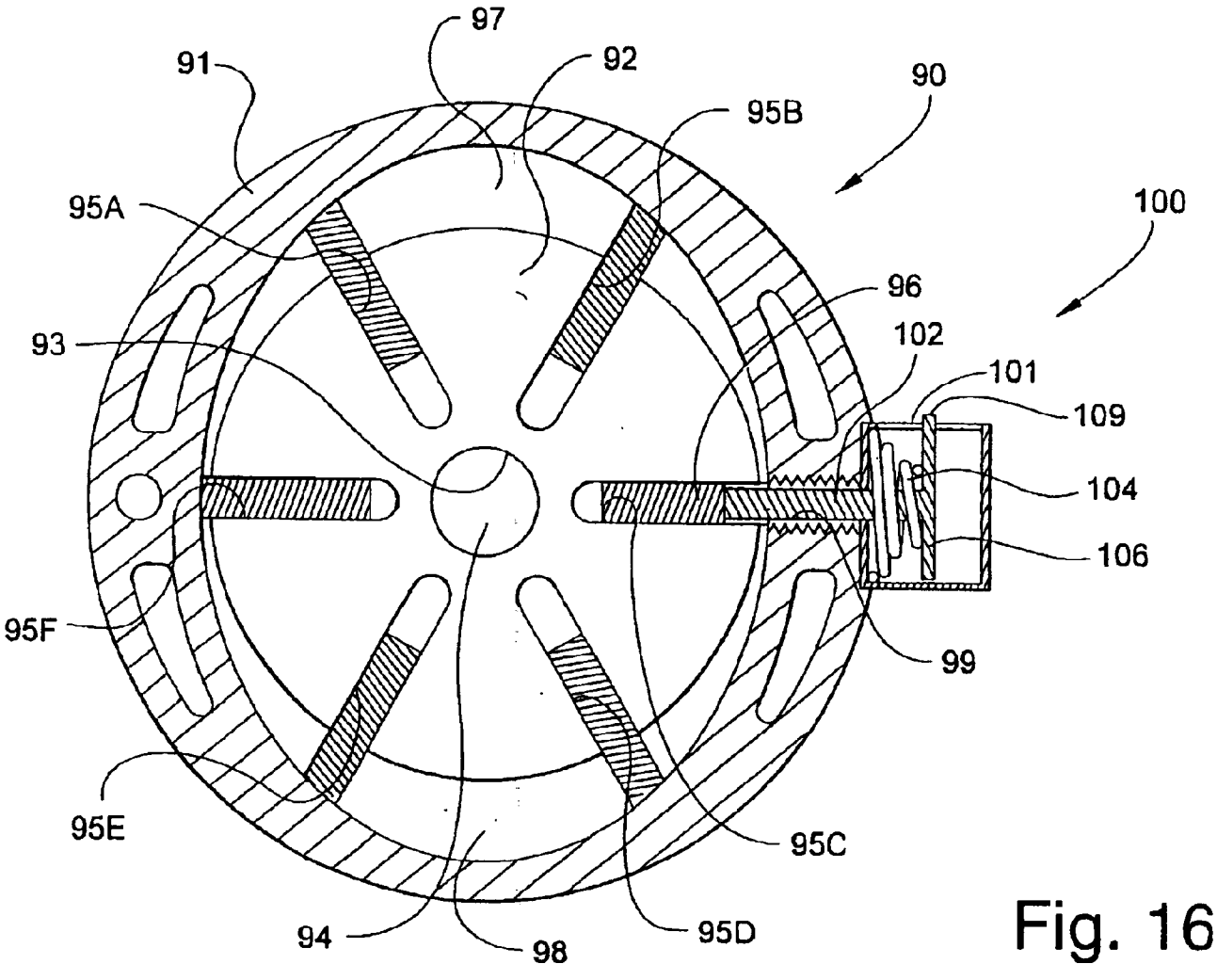
FIG. 16 is a vertical cross-section of the vane pump shown in FIGS. 14 and 15 showing the position of the spring-loaded stylus when the vane is in a condition requiring replacement.

In accordance with another embodiment of the invention, a spring-loaded probe may be used, as is shown in FIGS. 14–16. Pump 90 has a stator 91 defining an interior chamber and a rotor 92 as described above. The rotor 92 has a central bore 93 that receives a journal 94, and that provides a bearing surface for rotary movement of rotor 92 about its central axis. In the embodiment illustrated in FIG. 14, rotor 92 is provided with six circumferentially-spaced and radially-extending vane slots 95A–F that extend along the longitudinal length of rotor 92. Each slot 95A–F receives a respective vane 96 that slides in and out as the rotor 92 is rotationally driven about its center axis.

Stator 91 is provided with two symmetrically opposite lobes 97, 48, the surfaces of which act as cams that regulate the two extension and retraction cycles for the vanes 96, during each rotation of rotor 91. The sidewall of the stator 91 is provided with a threaded access port 99 that communicates with the chamber of the stator 91.

Progressive wear of the vanes 96 can be determined by means of a spring-loaded probe 100. The probe 100 is threaded into the access port 99, as shown, or can be secured by a snap ring, adhesive or otherwise. The probe 100 includes a probe housing 101 in which is positioned an elongate stylus 102. The stylus 102 is biased by a coil spring 104 positioned in the housing 101 around the stylus 102. The bias of the spring 104 is in the radial direction so that the end of the stylus 102 is normally retracted out of contact with a vane 96.

An enlarged alignment disk 106 is positioned on the outer end of the stylus 102 against which one end of the spring 104 bears. To determine vane wear, the disk 106 is depressed against the spring 104 so that the edge of the vane 96 can be sensed with the tip of the stylus 102. An indicator tab 109 is formed on an outer edge of the alignment disk 106 and extends through an observation slot 111 in the side of the housing 101. Alternatively, wear indication can be by reference to the edge of the disk 106 behind the observation slot 111 or window (not shown).

The tab 109 moves with the stylus 102. As is shown in FIG. 15, graduated markings 113 on the housing 102 adjacent the slot 113 indicate the various states of wear of the vanes 96. The markings can be lines, different color zones, words such as "OK", "BAD", "REPLACE", and so forth.

FIG. 14 indicates an unworn vane 96, and FIG. 16 indicates a worn vane 96.

The probe 100 can be placed on the pump 90 only when wear detection is desired, or it can be left on the pump 90. In either case, the probe 100 can be removed when visual observation is desired, for example, aligning the slot 95C with the access port 99. Alternatively, the stylus 102 can be lightly pressed against the rotor 92 and the tactile sense used to detect when a slot 95 has been reached. If the stylus 102 will not enter a slot, it is apparent that the vane 96 is new or almost new. As the vane 96 wears, the stylus 102 enters the respective slot 95A–F to a progressively deeper penetration.

A rotary vane pump with vane wear access port and method are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A rotary vane pump, comprising:

(a) a housing within which is rotatably mounted a rotor having a plurality of slots therein with a vane positioned for sliding movement within each of the slots;

(b) an access port in the housing communicating with the rotor at a reference position in relation to the slots, the access port being sized to:

(i) permit alignment of any one of the slots with the access port by rotating the rotor;

(ii) maintain the vane within the aligned one slot and at a datum within the slot; and (iii) permit entry into the access port and an aligned vane of a stylus having a predetermined length in relation to the datum for determining the length of the vane wherein the stylus includes a first portion that indicates that vane wear is within an acceptable limit for continued use, and a second portion thereon that indicates that vane wear has reached or exceeded an acceptable limit and that replacement is required;

whereby a determination of whether wear to the vane has met or exceeded a predetermined amount can be determined by reference to a portion of the stylus exterior to the access port.

2. A rotary vane pump according to claim 1, where the access port is positioned on a sidewall of the stator for accessing the rotor along an axially-extending surface thereof and for accessing the aligned vane along a longitudinal axis concentric with the longitudinal axis of the vane.

3. A rotary vane pump according to claim 2, wherein the stylus is mounted for sliding movement within a sleeve of a probe.

4. A rotary vane pump according to claim 2 or 3, wherein the probe includes a flange for being positioned against the housing adjacent the access port for stabilizing the probe and aligning the longitudinal axis of the stylus with the longitudinal axis of the aligned vane.

5. A rotary vane pump according to claim 1, wherein the datum comprises a radially-innermost end of the aligned vane.

6. A rotary vane pump according to claim 1, wherein the stylus includes a first indicia indicating that vane wear is within an acceptable limit for continued use and a second indicia indicating that vane wear has reached or exceeded an acceptable limit and that replacement is required.

7. A rotary vane pump according to claim 1, wherein the stylus includes a first color thereon that, when exposed exterior to the access port, indicates that vane wear is within an acceptable limit for continued use, and a second color thereon that, when only the second color is exposed exterior to the access port, indicates that vane wear has reached or exceeded an acceptable limit and that replacement is required.

8. A rotary vane pump according to claim 1, wherein the vanes are radially-aligned on the rotor.

9. A rotary vane pump according to claim 1, wherein the vanes are canted from a radius of the rotor.

10. A rotary vane pump according to claim 1, wherein the vanes are canted from a radius of the rotor, and a longitudinal axis of the access port is aligned with the longitudinal axis of the aligned vane.

11. A rotary vane pump according to claim 1, wherein the stylus is spring-loaded for urging the vane to the datum point within the aligned slot.

12. A rotary vane pump according to claim 1, wherein the stylus is spring-loaded within a sleeve for urging the vane to the datum point within the aligned slot.

13. A rotary vane pump according to claim 1, wherein the access port is circular in cross-section and further wherein the diameter of the access port is about the thickness of the vanes.

14. A method of determining wear to a vane of a rotary vane pump of the type having a plurality of vanes positioned for sliding movement within a plurality of respective slots formed in a rotor mounted for rotation in a pump housing, the method comprising the steps of:

(a) determining a reference position on the housing in relation to the slots;

(b) providing an access port in the pump housing at the reference position;

(c) rotating the rotor to align one of the slots with the access port;

(d) moving the vane in the one slot to a predetermined datum point;

(e) inserting a stylus into the access port and into contact with the vane in the aligned slot, said stylus comprising:

(i) a first portion that indicates that vane wear is within an acceptable limit for continued use; and (ii) a second portion that, indicates that vane wear has reached or exceeded an acceptable limit and that replacement is required; and (f) determining by reference to the stylus whether wear to the vane has met or exceeded a predetermined amount.

15. A method according to claim 14, wherein the step of providing an access port comprises forming the access port through an endwall of the housing from an exterior surface to an interior surface thereof.

16. A method according to claim 14, wherein the step of providing an access port comprises forming the access port through a sidewall of the housing from an exterior surface to an interior surface thereof.

17. A method according to claim 14, wherein the step of providing an access port comprises providing a bore extending through a sidewall of the housing from an exterior surface to an interior surface thereof.

18. A method according to claim 14, wherein the step of inserting the stylus into the aligned slot comprises the step of positioning a sleeve within which the stylus is contained for sliding movement against an outer surface of the housing adjacent the access port.

19. A method according to claim 14, wherein the step of determining by reference to an indicia associated with the stylus whether wear to the vane has met or exceeded a predetermined amount comprises the steps of:

(a) placing on the stylus a first color that, when exposed exterior to the access port, indicates that vane wear is within an acceptable limit for continued use; and (b) placing on the stylus a second color that, when only the second color is exposed exterior to the access port, indicates that vane wear has reached or exceeded an acceptable limit and that replacement is required.

20. A rotary machine, comprising:

(a) a housing within which is rotatably mounted a rotor having a plurality of slots therein with a vane positioned for sliding movement within each of the slots;

(b) an access port in the housing communicating with the rotor at a reference position in relation to the slots, the access port being sized to:

(i) permit alignment of any one of the slots with the access port by rotating the rotor;

(ii) maintain the vane within the aligned one slot and at a datum within the slot; and (iii) permit entry into the access port and an aligned vane of a stylus having a predetermined length in relation to the datum for determining the length of the vane wherein the stylus includes a first portion that indicates that vane wear is within an acceptable limit for continued use, and a second portion thereon that, indicates that vane wear has reached or exceeded an acceptable limit and that replacement is required;

whereby a determination of whether wear to the vane has met or exceeded a predetermined amount can be determined by reference to a portion of the stylus exterior to the access port.

* * * * *

UNITED STATES PATENT AND TRADEMARK OFFICE

CERTIFICATE OF CORRECTION

PATENT NO. : 6,769,886 B2
DATED : August 3, 2004
INVENTOR(S) : Timothy H. Henderson It is certified that error appears in the above-identified patent and that said Letters Patent is hereby corrected as shown below:

Column 9,
Lines 22 and 23, delete “46C” and enter -- 45C --.

Column 10,
Line 51, delete “48” and enter -- 98 --.

Column 11,
Line 49, delete “vane” and enter -- slot --.

Column 12,
Lines 32 and 36, delete “to” and enter -- away from --.

Signed and Sealed this

Seventh Day of December, 2004

JON W. DUDAS
*Director of the United States Patent and Trademark Office*